US009520654B2

(12) United States Patent
Melle et al.

(10) Patent No.: US 9,520,654 B2
(45) Date of Patent: Dec. 13, 2016

(54) SOURCE FOR PARABOLIC ANTENNA

(71) Applicant: Zodiac Data Systems, Les Ulis (FR)

(72) Inventors: Christophe Melle, Gujan-Mestras (FR); David Chaimbault, Gujan-Mestras (FR); Fabien Peleau, Mios (FR)

(73) Assignee: ZODIAC DATA SYSTEMS, Les Ulis (FR)

( * ) Notice: Subject to any disclaimer, the term of this patent is extended or adjusted under 35 U.S.C. 154(b) by 0 days.

(21) Appl. No.: 14/897,629

(22) PCT Filed: Jun. 16, 2014

(86) PCT No.: PCT/EP2014/062497

§ 371 (c)(1),
(2) Date: Dec. 10, 2015

(87) PCT Pub. No.: WO2014/202498

PCT Pub. Date: Dec. 24, 2014

(65) Prior Publication Data

US 2016/0141764 A1 May 19, 2016

(30) Foreign Application Priority Data

Jun. 17, 2013 (FR) ..... 13 55655

(51) Int. Cl.
*H01Q 19/17* (2006.01)
*H01Q 5/00* (2015.01)
(Continued)

(52) U.S. Cl.
CPC ..... *H01Q 19/17* (2013.01); *H01Q 5/40* (2015.01); *H01Q 9/285* (2013.01);
(Continued)

(58) Field of Classification Search
CPC ..... H01Q 19/17; H01Q 19/175; H01Q 21/06; H01Q 21/20; H01Q 21/24; H01Q 21/28; H01Q 21/30; H01Q 5/00; H01Q 9/28; H01Q 13/10; H01Q 19/13; H01Q 25/02

(58) Field of Classification Search
USPC ..... 343/725
See application file for complete search history.

(56) References Cited

U.S. PATENT DOCUMENTS 3,633,208 A * 1/1972 Ajioka ..... H01Q 19/17 342/368
4,283,728 A * 8/1981 Bartlett ..... H01Q 19/17 343/781 CA (Continued)

OTHER PUBLICATIONS

French Search Report and Written Opinion, dated Feb. 6, 2014, French Application No. 1355655.
International Search Report and Written Opinion with English Language Translation, dated Aug. 7, 2014, Application No. PCT/EP2014/062497.

*Primary Examiner* — Sue A Purvis
*Assistant Examiner* — Jennifer F Hu
(74) *Attorney, Agent, or Firm* — Blakely Sokoloff Taylor & Zafman LLP

(57) ABSTRACT

The invention relates to a source (S) for a parabolic antenna, comprising: •—a sigma radiating assembly (1S, 1C, 1L) suitable for generating the sigma channel including a sigma radiating element (11) positioned on a main transmission/reception axis (A) of the source (S), and a sigma supply circuit (12) to supply the sigma radiating element (11), and •—a delta radiating assembly (2S, 2C, 2L) suitable for generating the delta channel including eight delta radiating elements (21S, 21C, 21L), arranged around the main transmission/reception axis (S) of the source (S), and a delta supply circuit (22S, 22C, 22L).

14 Claims, 7 Drawing Sheets

(51) Int. Cl.

| | |
|---|---|
| ***H01Q 21/24*** | (2006.01) |
| ***H01Q 25/02*** | (2006.01) |
| ***H01Q 9/28*** | (2006.01) |
| ***H01Q 13/10*** | (2006.01) |
| ***H01Q 19/13*** | (2006.01) |
| ***H01Q 21/06*** | (2006.01) |
| ***H01Q 21/20*** | (2006.01) |
| ***H01Q 5/40*** | (2015.01) |
| ***H01Q 21/28*** | (2006.01) |

(52) U.S. Cl.

CPC ..... *H01Q 13/10* (2013.01); *H01Q 19/13* (2013.01); *H01Q 21/062* (2013.01); *H01Q 21/20* (2013.01); *H01Q 21/24* (2013.01); *H01Q 21/28* (2013.01); *H01Q 25/02* (2013.01)

(56) References Cited

U.S. PATENT DOCUMENTS

| | | | | | |
|---|---|---|---|---|---|
| 4,318,107 | A * | 3/1982 | Pierrot | ..... | H01Q 25/02<br>343/700 MS |
| 4,434,425 | A * | 2/1984 | Barbano | ..... | H01Q 19/17<br>343/797 |
| 4,649,391 | A * | 3/1987 | Tsuda | ..... | H01Q 25/02<br>342/153 |
| 5,382,959 | A * | 1/1995 | Pett | ..... | H01Q 21/24<br>343/700 MS |
| 2012/0306698 | A1 * | 12/2012 | Warnick | ..... | H01Q 5/35<br>342/372 |
| 2014/0203995 | A1 * | 7/2014 | Romney | ..... | H01Q 19/17<br>343/893 |

* cited by examiner

SOURCE FOR PARABOLIC ANTENNA

FIELD OF THE INVENTION

The present invention relates to a hyperfrequency source intended to be placed at the focus of a parabolic antenna.

PRIOR ART

Antennas used in telemetry generally comprise a parabolic reflector and a source placed at the focus of the parabolic reflector. The source is suitable for sending a signal to a target (such as a satellite or a flying vehicle for example) or receiving a signal transmitted by the target. The function of the reflector is to direct the signal sent by the source towards the target or concentrate the signal transmitted by the target on the source.

The frequency band in which signals are sent or received depends on the type of target. Each source is generally adapted to transmit in a given frequency band corresponding to a type of target.

Consequently, to be able to exchange data with different types of targets, it is necessary to disassemble the source of the antenna and install a new source in place. These disassembly and assembly operations take time and can cause errors in alignment of the source and of the reflector, which alter the radiation pattern of the antenna.

There are also bi-band antennas comprising a first source capable of transmitting in a first frequency band, a second source capable of transmitting in a second frequency band, a principal reflector and an auxiliary reflector with dichroic surface. The first source is placed at the focal point of the principal reflector while the second source is placed at the focal point of the auxiliary reflector. The auxiliary reflector comprises a dichroic surface adapted to let through radiation in the first frequency band and to reflect radiation in the second frequency band. The signals transmitted by the target in the first frequency band are reflected by the principal reflector towards the first source by passing through the auxiliary reflector. The signals transmitted by the target in the second frequency band are reflected successively by the principal reflector and the auxiliary reflector towards the second source.

However, such a bi-band antenna is costly especially as it requires the use of a reflector with dichroic surface.

Document US2011/029903 also discloses a multi band source adapted to receive or send simultaneously in three frequency bands. More precisely, the source is capable of transmitting in frequency bands L (1 GHz to 2 GHz), S (2 GHz to 4 GHz) and C (4 to 8 GHz). The source comprises a central cylindrical waveguide and three coaxial conductive cylinders extending about the central cylindrical waveguide and forming three respective coaxial waveguides. Each of the three waveguides enclosing the central waveguide is delimited by two successive cylinders.

The central cylindrical waveguide is adapted to generate sum channel radiation (or sigma channel) in the C-band. The first cylindrical waveguide enclosing the central waveguide is adapted to generate selectively a channel radiation difference (delta) in the C-band or a sum channel radiation in the S-band. The second cylindrical waveguide enclosing the first waveguide is adapted to generate selectively channel radiation difference in the S-band or sum channel radiation in the L-band. Finally, the third cylindrical waveguide enclosing the second waveguide is adapted to generate channel radiation difference in the L-band.

The waveguides are supplied by coaxial transitions via a plurality of input ports. Such waveguides are particularly difficult to excite such that their sizing is complex. To minimise reflection losses, document US2011/0291903 especially provides for the source to comprise radial ridges arranged inside the waveguides, each ridge being coupled to an input port and to a cylinder.

Also, as the same waveguide is used to generate radiation in two frequency bands this type of source does not decouple the different frequency bands.

SUMMARY OF THE INVENTION

An aim of the invention is to propose a source for parabolic antenna which is easier to design.

This aim is achieved within the scope of the present invention by a source for parabolic antenna, comprising:

- a sigma radiating assembly comprising a sigma radiating element positioned on a main transmission/reception axis of the source, and a sigma supply circuit for supplying the sigma radiating element so that the sigma radiating element generates sigma channel radiation, and
- a delta radiating assembly comprising eight delta radiating elements arranged about the main transmission/reception axis of the source, and a delta supply circuit for supplying the delta radiating elements so that the delta radiating elements generate delta channel radiation.

In such a source, delta channel radiation is generated independently of the radiation of the sigma channel.

Also, the use of eight delta radiating elements improves decoupling between the radiations of sigma and delta channels.

The source can further have the following characteristics:

- the sigma radiating element extends in a plane perpendicular to the main transmission/reception axis of the source,
- the sigma radiating element comprises a radiating patch and a ground plane having coupling slots, the coupling slots being arranged according to an invariant design by rotation of 90 degrees about the main transmission/reception axis of the source,
- the delta radiating elements are arranged on a circle centred on the main transmission/reception axis of the source,
- the delta radiating elements are arranged with angular spacing of 45 degrees between two successive delta elements,
- each delta radiating element comprises a radiating patch connected to the delta supply circuit by a supply point, all the patches and their supply points being arranged according to an invariant design by rotation of 45 degrees about the main transmission/reception axis of the source,
- the delta radiating elements extend in a same plane perpendicular to the main transmission/reception axis of the source,
- the delta radiating elements are polarized radially relative to the main transmission/reception axis of the source,
- each delta radiating element comprises a quarter-wave radiating patch,
- each delta radiating element comprises a half-wave radiating patch and a parasite patch,
- the delta radiating elements each extend in a plane parallel to the main transmission/reception axis of the source, the delta radiating elements are polarized tangentially relative to the main transmission/reception axis of the source, each delta radiating element comprises a half-wave dipole, the delta radiating elements comprise two groups of four delta radiating elements, each group being supplied by the delta supply circuit in TE21 mode, the delta radiating elements of one group being supplied with phase shifting of 90 degrees relative to the delta radiating elements of the other group;

the source comprises three sigma radiating assemblies each operating in a different frequency band and three delta radiating assemblies each operating in one of said frequency bands, the sigma radiating elements of the three sigma radiating assemblies being arranged in tiers and centred on the main transmission/reception axis of the source, the sigma radiating elements operating in a higher frequency band being tiered, in the direction of propagation of the electromagnetic wave, above the sigma radiating elements operating in a lower frequency band;

the sigma radiating elements operating in a lower frequency band are combined with the ground plane of the sigma radiating elements operating in a higher frequency band.

The invention also relates to an antenna comprising a parabolic reflector having a focus, and a source such as defined previously, placed at the focus of the parabolic reflector.

DESCRIPTION OF FIGURES

Other aims, characteristics and advantages will emerge from the following detailed description in reference to the appended drawings given by way of illustration and non-limiting, in which.

DETAILED DESCRIPTION OF THE INVENTION

In reference to FIGS. 1 to 5, the source S for parabolic antenna comprises a mechanical base 3 and three sigma radiating assemblies 1C, 1S and 1L providing a sigma pattern for the three frequency bands C, S and L respectively, and three delta radiating assemblies 2C, 2S and 2L supplying a delta pattern for the three frequency bands C, S and L respectively. The radiating assemblies are attached to the mechanical base.

The radiating assemblies comprise:

a first sigma radiating assembly 1L suitable for generating a sigma radiation pattern for the first frequency L-band, a first delta radiating assembly 2L suitable for generating a delta radiation pattern for the first frequency L-band, a second sigma radiating assembly 1S suitable for supplying a sigma radiation pattern for the second frequency S-band, a second delta radiating assembly 2S suitable for generating a delta radiation pattern for a second frequency S-band, a third sigma radiating assembly 1C suitable for supplying a sigma radiation pattern for the third frequency C-band, and a third delta radiating assembly 2C suitable for supplying a delta radiation pattern for the third frequency C-band.

The delta radiation pattern supplies a monotone signal function of the deviation of the target to the axis of the antenna while the sigma radiation pattern gives a maximum signal in the axis. These patterns produce a deviation measurement with sign and normalise measuring. The deviation measurement function is gained by forming the ratio, of amplitude and phase, of the delta pattern on the sigma pattern. The slope of this deviation measurement function is almost constant in the central part of the sigma pattern. As is known, it is possible to extract an angular deviation between the position of the target and the axis of the antenna from the two signals received simultaneously by the antenna on its two sigma and delta channels and for all frequency bands L, S and C.

The source has a main transmission/reception axis A. Each of the three sigma radiating assemblies 1C, 1S and 1L extends in a plane perpendicular to the main transmission/reception axis A of the source S.

Each of the three sigma radiating assemblies 1C, 1S and 1L comprises a sigma radiating element 11 positioned on the main transmission/reception axis A of the source S, and a sigma supply circuit 12 for supplying the sigma radiating element 11 so as to generate sigma channel radiation.

Figure 1:
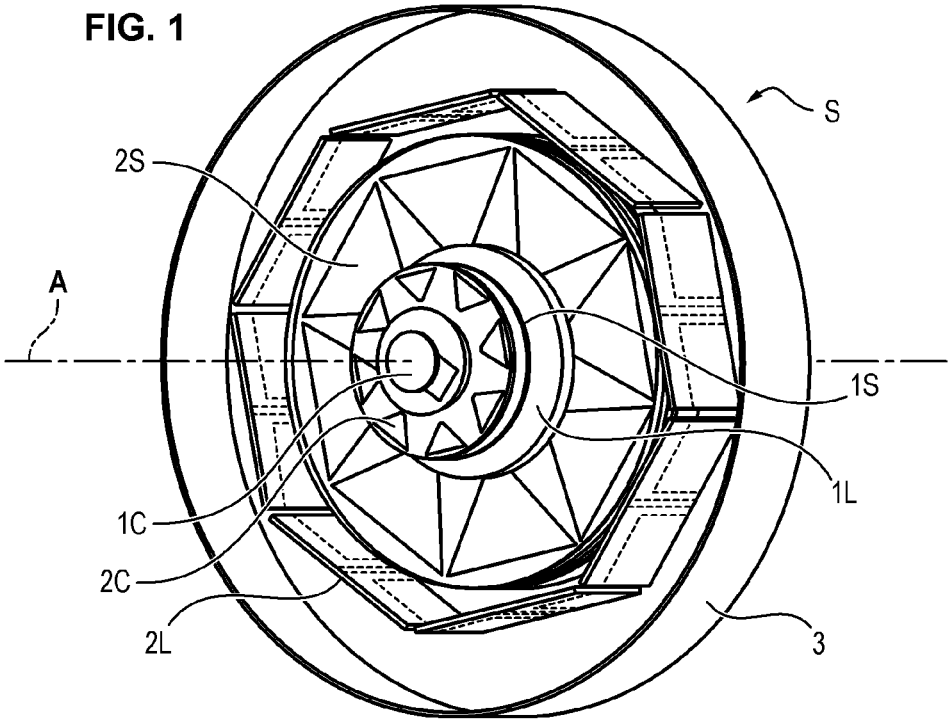
FIG. 1 is a view of a source according to an embodiment of the invention.
Figure 2:
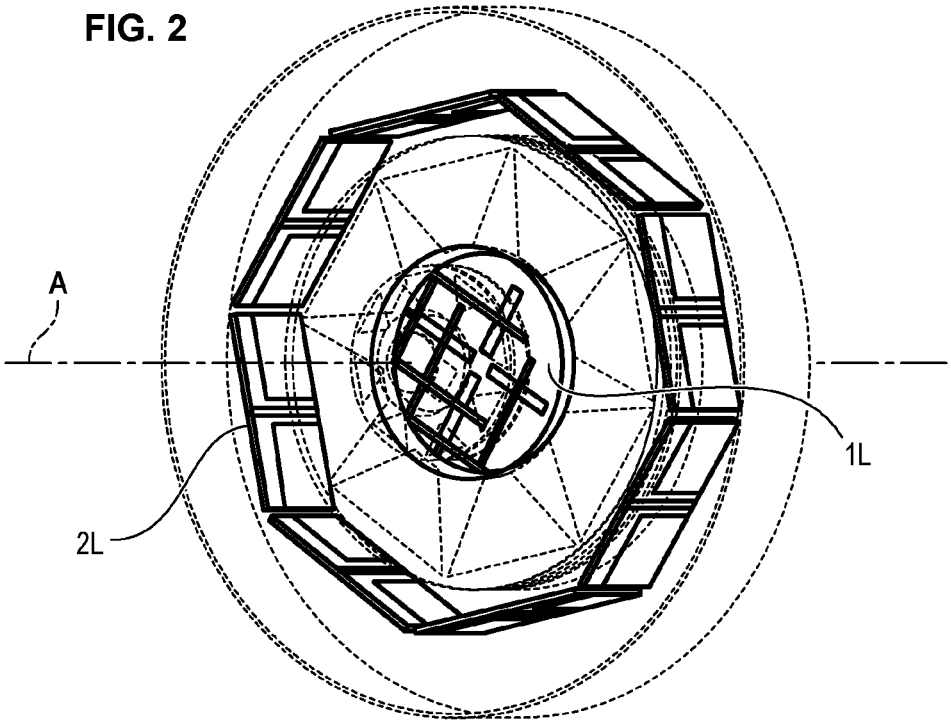
FIG. 2 is a view of the source on which the first sigma radiating assembly and the first delta radiating assembly are highlighted.
Figure 3:
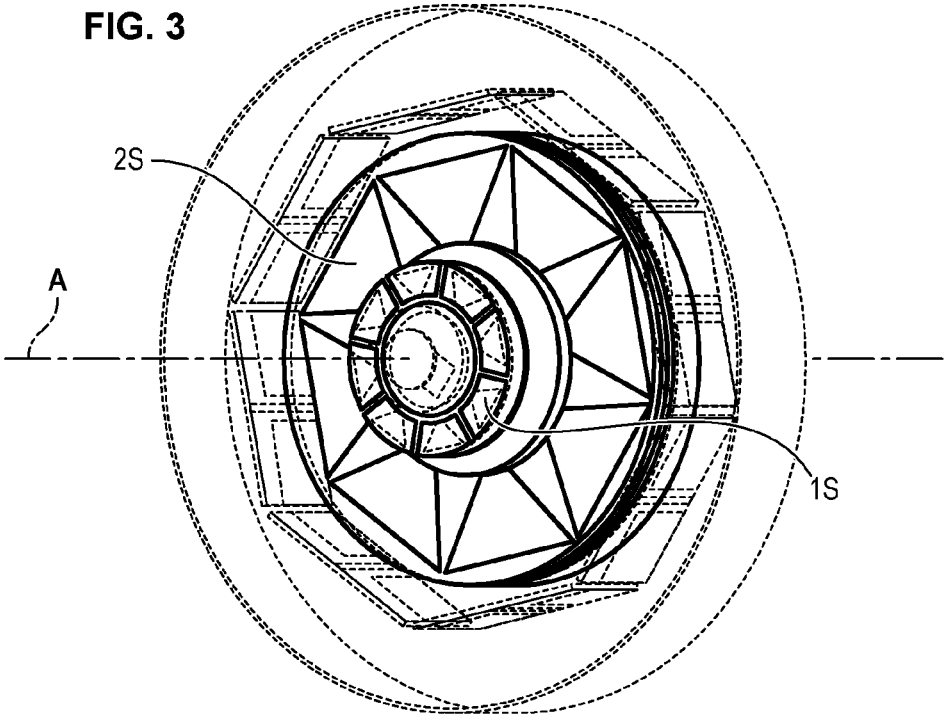
FIG. 3 is a view of the source on which the second sigma radiating assembly and the second delta radiating assembly are highlighted.
Figure 4:
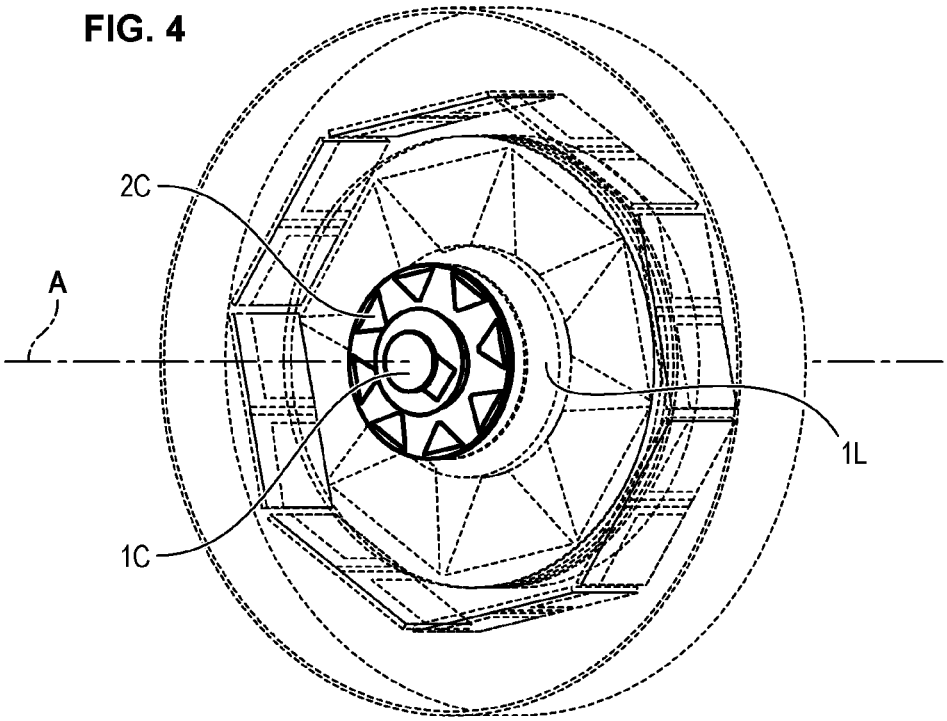
FIG. 4 is a view of the source on which the third sigma radiating assembly and the third delta radiating assembly are highlighted.
Figure 5:
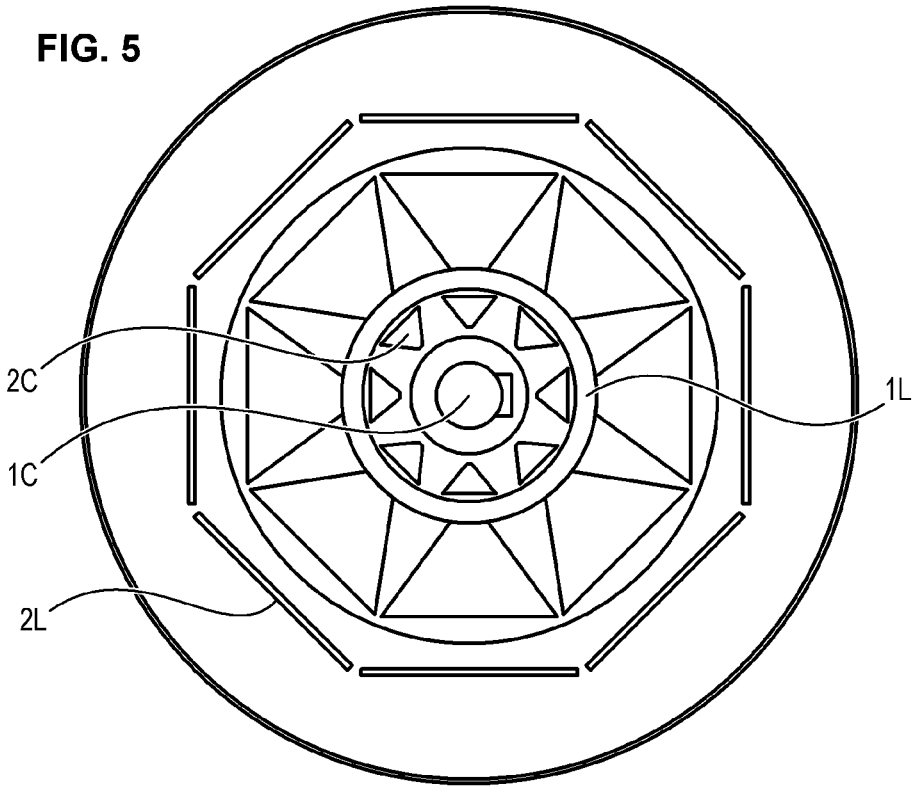
FIG. 5 is a frontal view of the source.
Figure 6:
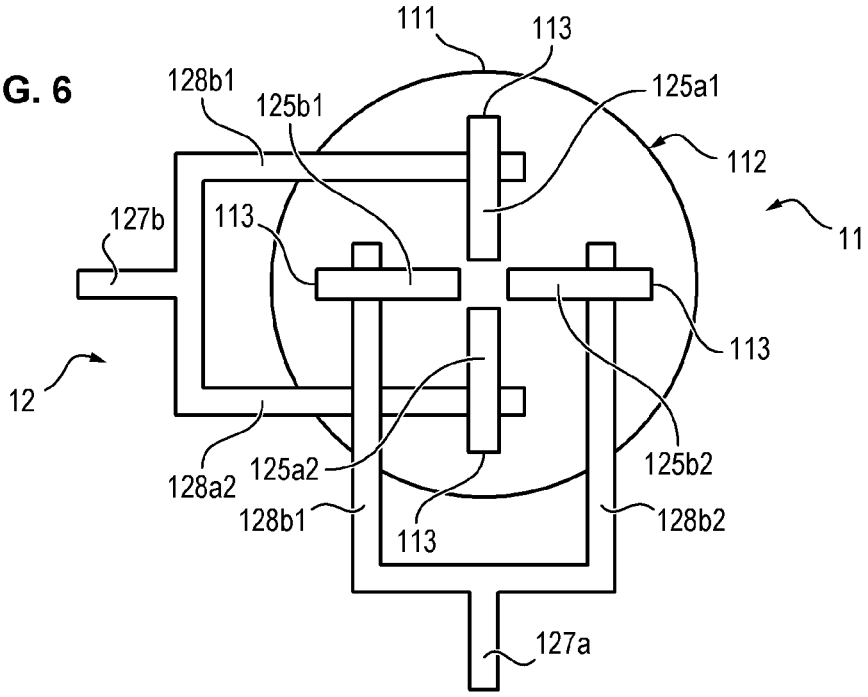
FIG. 6 is a schematic view of a the sigma radiating element.

The three sigma radiating assemblies 1C, 1S and 1L comply with the sigma radiating assembly 1 shown in general in FIG. 6.

In reference to FIG. 6, each sigma radiating element 11 comprises a circular radiating patch (or paving) 111 and a ground plane 112 having coupling slots 113. The sigma radiating element 11 comprises three layers of metallisation and two substrates. The sigma radiating element 11 and the sigma supply circuit 12 are separated by the ground plane 112 in which coupling electromagnetic slots 113 are etched to ensure supply to the sigma radiating element 11.

Each sigma radiating element 11 is coupled with the sigma supply circuit 12 at the level of coupling points 125 by means of coupling slots 113. The coupling slots 113 and the coupling points 125 are arranged according to an invariant design by rotation of 90 degrees about the main transmission/reception axis A of the source S. The symmetry of this configuration minimises crossed polarization.

The four coupling slots 113 are arranged in a cross. In other words, the coupling slots 113 are arranged in pairs according to two perpendicular axes centred on the main transmission/reception axis of the source. Each sigma supply circuit 12 comprises two supply ports 127*a* and 127*b* positioned each in two layers on either side of the circular radiating patch 111 in two layers of dielectrics. These two supply ports 127*a* and 127*b* are in phase. Each of the supply ports 127*a* and 127*b* supplies two supply branches respectively 128*a*1 and 128*a*2 and 128*b*1 and 128*b*2 positioned on either side of the circular radiating patch 111 and coupled to the radiating patch at four coupling points 125*a*1, 125*a*2, 125*b*1 and 125*b*2. The supply ports 127*a* and 127*b* each generate a rectilinear polarization mode, the rectilinear polarization modes of the two supply branches being orthogonal in pairs and in phase quadrature, making it possible to generate circular polarization in both directions, left and right.

The radiating elements 11 of the sigma channels all have symmetries on two orthogonal axes, enabling good decoupling between the supply ports 127*a* and 127*b* having rectilinear and orthogonal polarizations, and between the delta and sigma channels.

Each of the delta radiating assemblies 2S, 2C, 2L comprises eight delta radiating elements, respectively 21S, 21C, 21L, and a delta supply circuit, respectively 22S, 22C, 22L. The delta radiating elements 21S, 21C or 21L of the same assembly are arranged on a circle centred on the main transmission/reception axis A of the source S. Also, the delta radiating elements 21S, 21C, 21L are arranged with angular spacing of 45 degrees between two successive delta elements 21S, 21C, 21L.

Each delta radiating element 21S, 21C, 21L comprises a radiating patch (or paving) 211S, 211C, 211L connected to the associated delta supply circuit 22S, 22C, 22L via a supply point 225S, 225C, 225L. All the patches 211S, 211C, 211L of the same delta radiating assembly 2S, 2C, 2L and their supply points 225S, 225C, 225L are arranged according to an invariant design by rotation of 45 degrees about the main transmission/reception axis A of the source S.

The delta radiating elements 21L of the first delta radiation assembly 2L each extend in a plane parallel to the main transmission/reception axis A of the source S and tangential to a cylinder of revolution having for axis the main transmission/reception axis A of the source S.

Each of the eight delta radiating elements 21L of the first delta radiation assembly 2L comprises a patch 211L comprising a dielectric substrate 2111L of rectangular form and a layer of metallic conductor 2113L typically made of copper.

Figure 7:
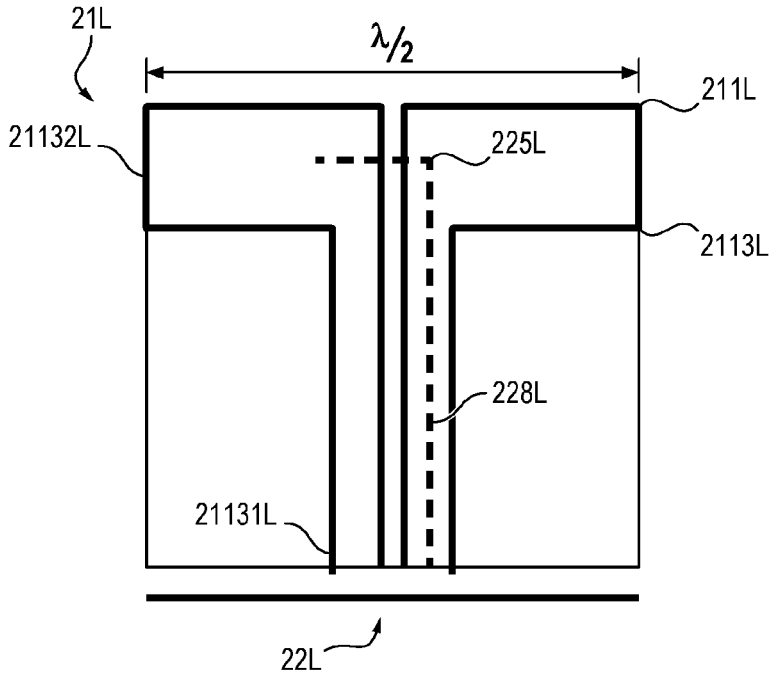
FIG. 7 is a schematic view of a patch of a delta radiating element of the first delta radiation assembly.
Figure 8:
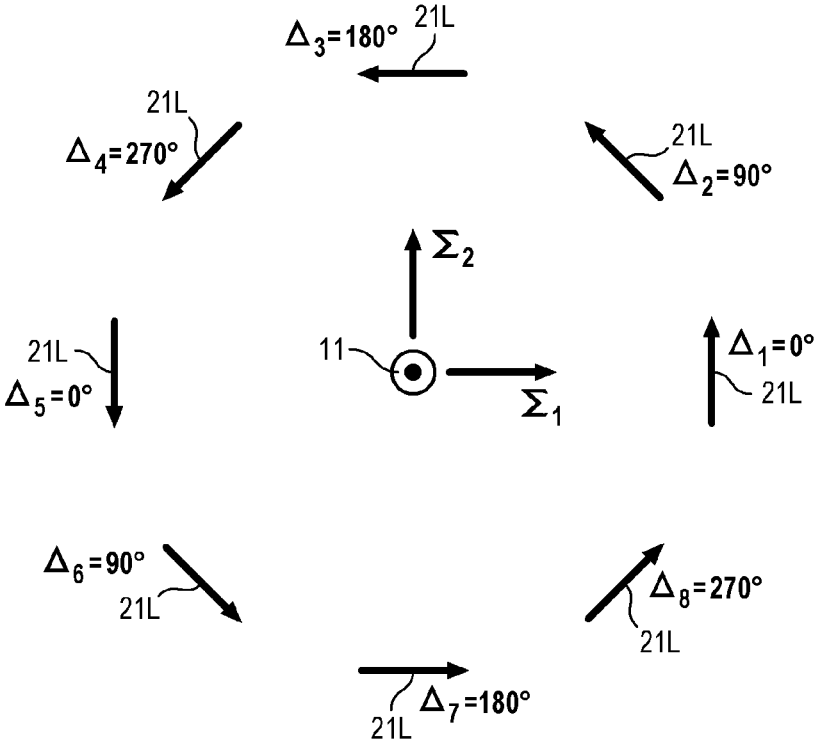
FIG. 8 is a polarization diagram of the first delta radiation assembly.

In reference to FIG. 7, the metallic conductor 2113L has a first section 21131L extending in the direction of the axis of the source and a second section 21132L extending in the direction perpendicular to the axis of the source and contained in the plane of the delta radiating elements 21L. The second part has a length substantially equal to half the average wavelength λ of the first band of wavelength L. The delta supply circuit 22L of the first delta radiation assembly 2L comprises for each of the eight patches 211L a supply line 228L supplying the patch 211L at the level of a supply point 225L positioned at the centre of the patch. The current supplied to each line 228L is in phase opposition such that the current is maximum at the centre of the patch. Each of the eight patches 211L of the delta radiating elements 21L of the first delta radiation assembly 2L resonates in half-wave, as a dipole. In reference to FIG. 8, the delta radiating elements 21L of the first delta radiation assembly 2L are polarized tangentially relative to the circle on which the delta radiating elements 21L are arranged.

The delta radiating elements 21C of the second delta radiation assembly 2C extend in a same plane perpendicular to the main transmission/reception axis A of the source S.

The delta radiating elements 21S of the second delta radiation assembly 2S also extend in the same plane perpendicular to the main transmission/reception axis A of the source S.

Figure 9:
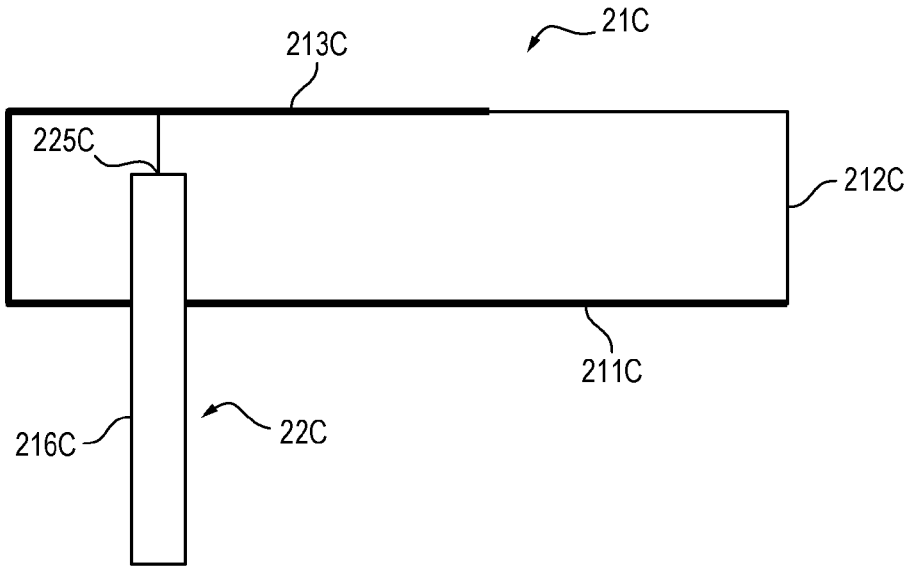
FIG. 9 is a schematic view of a patch of a delta radiating element of the second delta radiation assembly.

In reference to FIG. 9, the eight delta radiating elements 21C of the third delta radiation assembly 2C each comprise a ground plane 211C, a first dielectric substrate 212C in contact with the ground plane 211C, a trapezoid quarter-wave patch 211C made of copper formed on the first dielectric substrate 212C and connected in short-circuit to the ground plane 213C. The quarter-wave trapezoid patch 211C is supplied by a coaxial cable 216C at the level of a supply point 225C.

Figure 10:
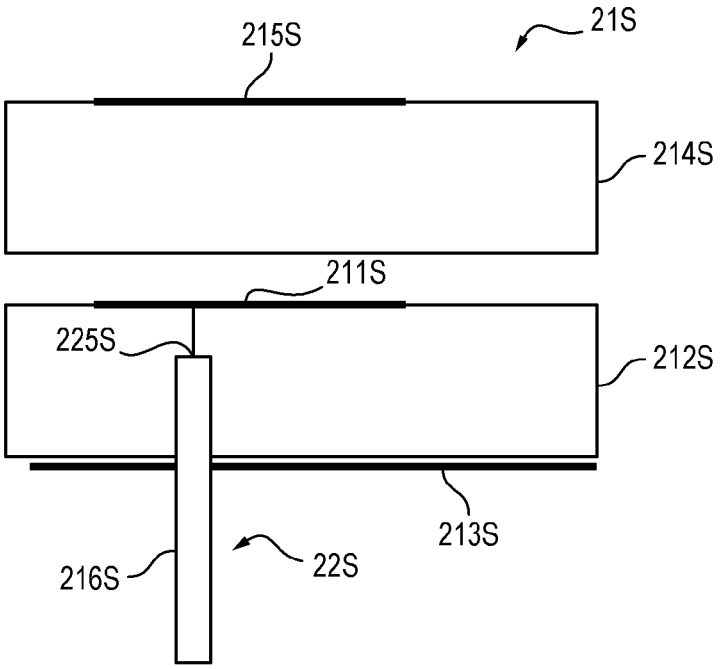
FIG. 10 is a schematic view of a patch of a delta radiating element of the third delta radiation assembly.

In reference to FIG. 10, the eight delta radiating elements 21S of the second delta radiation assembly 2S each comprise a ground plane 213S, a first dielectric substrate 212S in contact with the ground plane, a half-wave trapezoid patch 211S made of copper deposited on the first dielectric substrate 212S, a second dielectric substrate 214S in a plane parallel to the first dielectric substrate 212S and a parasite patch 215S made of copper deposited on the second dielectric substrate 214S. The half-wave trapezoid patch 211S is supplied by a coaxial cable 216S at the level of a supply point 225S. The parasite patch 215S plays the role of director and modifies the field radiated by the half-wave trapezoid patch 211S.

Figure 11:
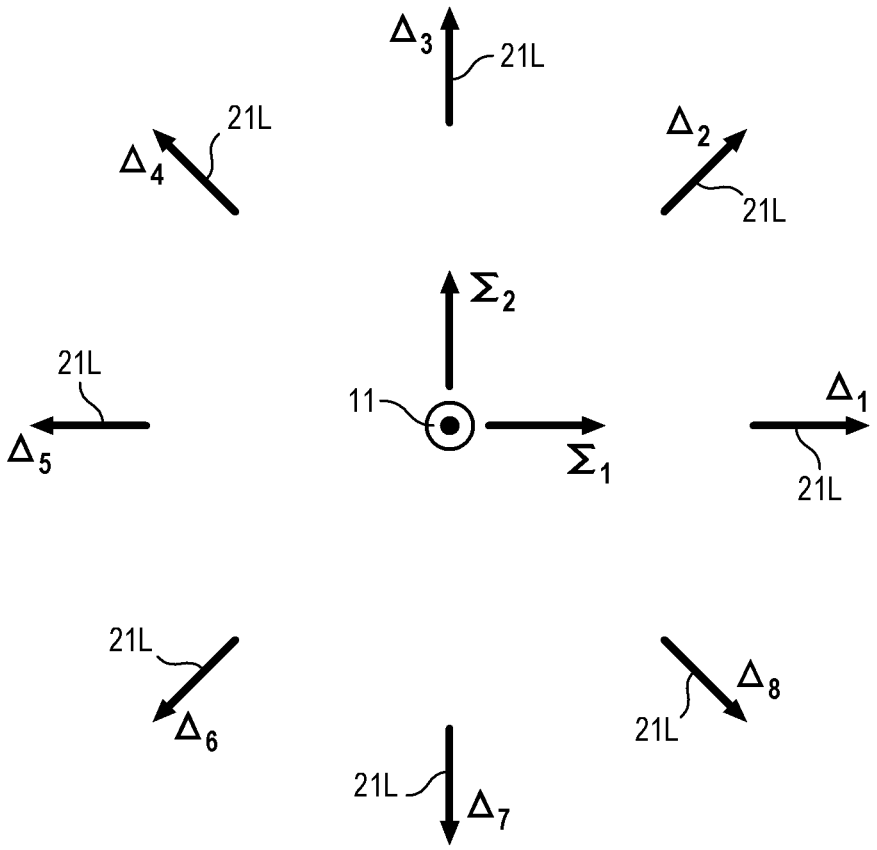
FIG. 11 is a polarization diagram of the second or of the third delta radiation assembly.

In reference to FIG. 11, the delta radiating elements 21S and 21C of the second and third delta radiation assembly 2S and 2C are polarized radially relative to the main transmission/reception axis A of the source S.

The delta radiating elements 21S, 21C, 21L of the first, second and third delta radiating assemblies comprise two groups of four delta radiating elements 21S, 21C, 21L, each group being supplied by the delta supply circuit 22S, 22C, 22L in TE21 mode, the delta radiating elements 21S, 21C, 21L of one group being supplied in phase quadrature relative to the delta radiating elements 21S, 21C, 21L of the other group. The delta radiating elements 21S, 21C, 21L of each delta radiating assembly generate a map of electromagnetic fields equivalent to that of the TE21 mode existing in waveguides.

The delta radiating elements of the same delta radiating assembly are supplied in equi-amplitude and so that the radius of the circle on which the eight delta radiating elements are positioned is less than the wavelength corresponding to the maximum frequency of the frequency band of the delta radiating assembly.

The central symmetry of the delta radiating elements 21S, 21C, 21L associated with the sigma radiating elements of central symmetry uncouples the sigma patterns and the delta patterns. The resulting advantage is that generation of the sigma patterns and delta patterns in the different frequency bands L, S and C occurs independently. Also, it eventuates that the sigma and delta patterns in the different frequency bands L, S are uncoupled.

It is possible to interlock different operating radiating elements in different frequency bands and generate sigma and delta patterns for the three different frequency bands without radiations being perturbed, and in a reduced space, by avoiding using structures made of heavy and costly waveguide.

The sigma radiating elements 1S, 1C, 1L of the first, second and third sigma radiating assemblies 1S, 1C, 1L are arranged in tiers and centred on the main transmission/ reception axis A of the source, the radiating patches in each frequency band serve as ground plane to the sigma radiating elements 1S, 1C, 1L of the upper stages, the sigma radiating elements 1S, 1C, 1L being tiered, in the direction of propagation of the electromagnetic wave, according to their operating frequency bands, that is, the lowest frequencies towards the highest frequencies.

Figure 12:
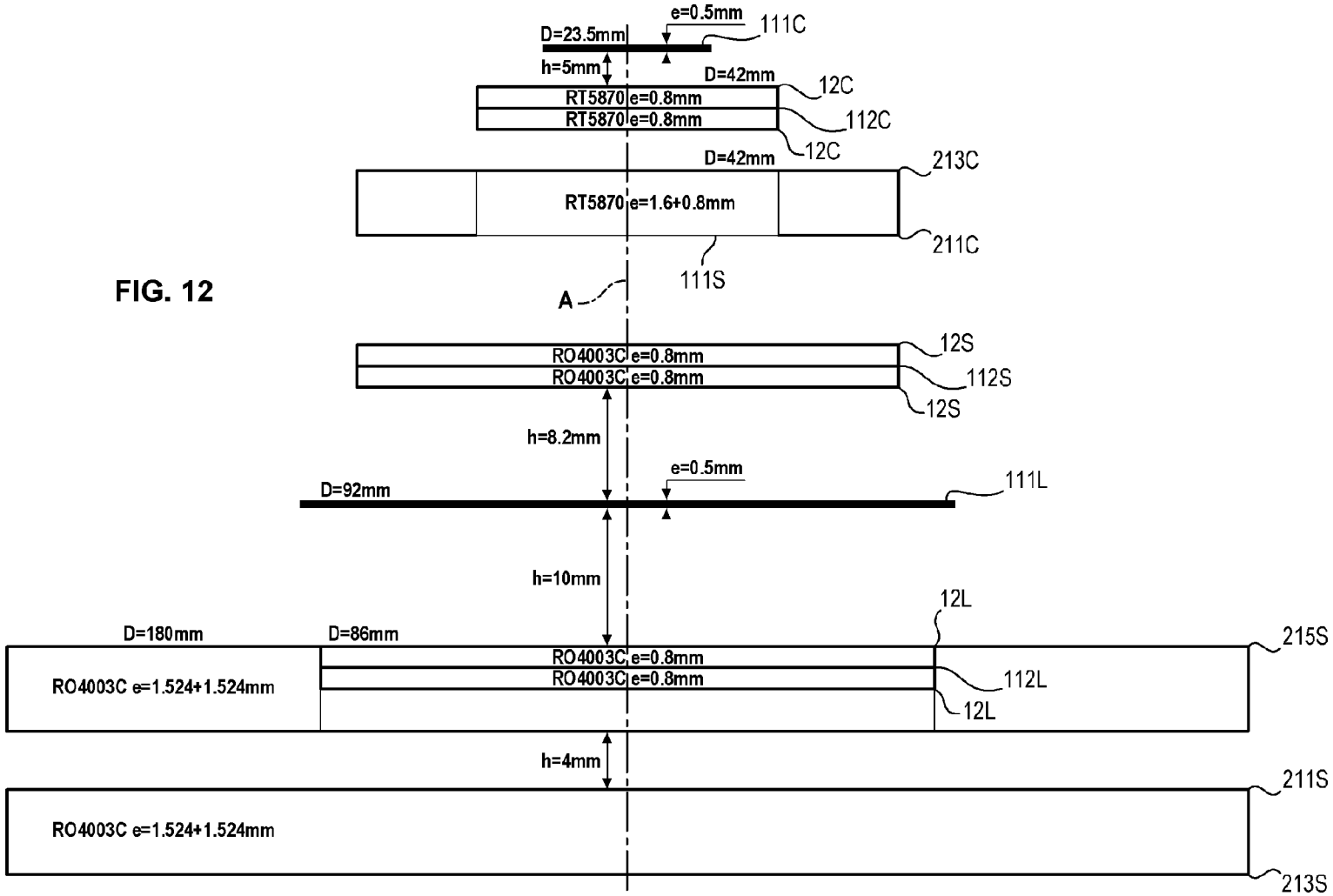
FIG. 12 is a sectional view in a plane containing a main transmission/reception axis of the source.

In reference to FIG. 12, the different elements of the radiating assemblies 1C, 1S, 1L and 2C, 2S, 2L are tiered on the axis A of the source S. When travelling through the axis of the source in the reverse direction of propagation of the electromagnetic wave, the different elements are positioned in the following order, from top to bottom of the source:

- the circular radiating patch 111C of the third sigma radiating assembly;
- the ground plane 112C of the third sigma radiating assembly on which the branches of a port of the supply circuit 12C are deposited;
- the quarter-wave trapezoid patches 213C of the third delta radiation assembly 2C deposited on the ground plane 211C of the third delta radiation assembly 2C;
- the radiating circular patch 111S of the second delta radiation assembly 2S positioned at the centre of the quarter-wave trapezoid patches 213C of the third delta radiation assembly 2C;
- the ground plane 112S of the second sigma radiating assembly on each of the faces of which are deposited the branches of a port of the supply circuit 12S;
- the circular radiating patch 111L of the first sigma radiating assembly;
- the parasite patches 215S positioned at the level of the ground plane 112L of the first sigma radiating assembly, the ground plane 112L of the first sigma radiating assembly and the supply circuit 12L being positioned at the centre of the half-wave trapezoid patches 21S of the second assembly of radiation delta 2S.

The radiating elements of the first radiating assembly 2L are positioned about the second radiating assembly 2S.

The constant dielectrics of the different dielectrics 212C, 214S, 212S, 12S, 12C, 12L are selected so as to respect the maximum radius of the network.

The source described is characterized by minimal bulk, low weight and good directivity performance, figure of merit G/T and tracking of a mobile target for a multi-band antenna. Also, this type of multi-band source is also highly adapted for equipping prime-focus parabolas of small diameter rather than large diameter. The source can receive in the three frequency bands L, S and C simultaneously and, still simultaneously, conduct tracking of monopulse type.

The fact of minimising the diameter of the circles on which the radiating elements 2C, 2S, 2L are positioned produces a pronounced tracking slope, however the greater the tracking slope the better the tracking. On the other hand in the source described, the tracking slopes or deviation measurements are uniform in all planes and do not degrade as a function of the polarization of the signal received.

The source described is particularly well adapted to function in frequency bands L=[1.4; 1.55 GHz], S=[2.2; 2.4 GHz] and C=[5.0; 5.25 GHz]. The source described for example maintains a reception system already existing in S-band and pre-equips this system for the future C-band. Also, with the source described, it is no longer necessary to change source to change frequency band, the source change operation requiring means, manoeuvring time and adjustment.

The invention can also be executed to generate other frequency bands of telecommunications, telemetry, or any other reception frequency band.

The multi-band source described is placed at the focus of a principal parabolic reflector. The multi-band source described prevents use of installation with two reflectors, main reflector and sub-reflector, commonly known as Cassegrain mounting, especially on small-diameter antennas. The use of a dichroic sub-reflector is therefore not required and this also prevents coupling problems between separate sources.

The source simultaneously undertakes reception and monopulse tracking of mobile targets in the three frequency bands L, S and C and is light and compact.

The invention claimed is:

1. source for parabolic antenna, comprising:

a sigma radiating assembly adapted to generate the sigma channel comprising a sigma radiating element positioned on a main transmission/reception axis of the source, and a sigma supply circuit for supplying the sigma radiating element, and a delta radiating assembly adapted to generate the delta channel comprising eight delta radiating elements arranged about the main transmission/reception axis of the source, and a delta supply circuit, wherein the delta radiating elements are arranged on a circle centred on the main transmission/reception axis of the source and the delta radiating elements are arranged with angular spacing of 45 degrees between two successive delta elements.

2. The source according to claim 1, wherein the sigma radiating element extends in a plane perpendicular to the main transmission/reception axis of the source.

3. The source according to claim 1, wherein the sigma radiating element comprises a radiating patch and a ground plane having coupling slots, the coupling slots being arranged according to an invariant design by rotation of 90 degrees about the main transmission/reception axis of the source.

4. The source according to claim 1, wherein each delta radiating element comprises a radiating patch connected to the delta supply circuit via a supply point, all the patches and their supply points being arranged according to an invariant design by rotation of 45 degrees about the main transmission/reception axis of the source.

5. The source according to claim 1, wherein the delta radiating elements extend in the same plane perpendicular to the main transmission/reception axis of the source.

6. The source according to claim 5, wherein the delta radiating elements are polarized radially relative to the main transmission/reception axis of the source.

7. The source according to claim 5 or claim 6, wherein each delta radiating element comprises a quarter-wave radiating patch.

8. The source according to claim 5, wherein each delta radiating element comprises a half-wave radiating patch and a parasite patch.

9. The source according to claim 1, wherein the delta radiating elements each extend in a plane parallel to the main transmission/reception axis of the source.

10. The source according to claim 9, wherein the delta radiating elements are polarized tangentially relative to the main transmission/reception axis of the source.

11. The source according to claim 9, wherein each delta radiating element comprises a half-wave dipole.

12. The source according claim 1, wherein the delta radiating elements comprise two groups of four delta radiating elements, each group being supplied by the delta supply circuit in TE21 mode, the delta radiating elements of one group being supplied with phase shifting of 90 degrees relative to the delta radiating elements of the other group.

13. The source according to claim 1, comprising three sigma radiating assemblies each operating in a different frequency band and three delta radiating assemblies each operating in one of said different frequency bands, the sigma radiating elements of the three sigma radiating assemblies being arranged in tiers and centred on the main transmission/reception axis of the source, the sigma radiating elements operating in a higher frequency band being tiered, in the direction of propagation of the electromagnetic wave, above the sigma radiating elements operating in a lower frequency band.

14. The source according to claim 13, wherein the sigma radiating element comprises a radiating patch and a ground plane having coupling slots, the coupling slots being arranged according to an invariant design by rotation of 90 degrees about the main transmission/reception axis of the source and the sigma radiating elements operating in a lower frequency band are combined with the ground plane of the sigma radiating elements operating in a higher frequency band.

* * * * *